United States Patent [19]

Niggemeier et al.

[11] 4,236,853

[45] Dec. 2, 1980

[54] PLATED CONTAINER PEDESTAL LOCKING MEMBER

[75] Inventors: Joseph F. Niggemeier; David A. Stoller; William J. Xander, all of St. Charles, Mo.

[73] Assignee: ACF Industries, Incorporated, New York, N.Y.

[21] Appl. No.: 943,024

[22] Filed: Sep. 18, 1978

[51] Int. Cl.[3] ..... B61D 17/10

[52] U.S. Cl. ..... 410/77; 292/128; 410/79; 428/657

[58] Field of Search ..... 428/657, 681; 70/464; 292/DIG. 57, DIG. 58, 78, 1, 128; 308/3 R; DIG. 8; 105/366 R, 366 E, 366 C, 366 D; 204/50 R; 410/52, 68–76, 77, 78, 79

[56] References Cited

U.S. PATENT DOCUMENTS

| | | | |
|---|---|---|---|
| 1,988,504 | 1/1935 | McCullough | 75/151 |
| 2,845,918 | 8/1958 | Goodzheit | 75/151 |
| 3,565,013 | 2/1971 | Terlecky et al. | 105/366 D |
| 3,667,401 | 6/1972 | Schwiebert et al. | 105/366 D |
| 3,827,375 | 8/1974 | Terlecky et al. | 105/366 D |

FOREIGN PATENT DOCUMENTS

| | | | |
|---|---|---|---|
| 41-3685 | 3/1966 | Japan | 75/151 |

OTHER PUBLICATIONS

Lyman, T., ed.; *Metals Handbook* vol. 2 , 8th edition; ASM, Metals Park, Ohio; pp. 409, 415, TA472A3 (1964).

"Mechanical Plating with Tin–Cadmium Alloy", *Tin and its Uses* Quarterly Journal of the Int. Tin Research Inst. #112, pp. 4, 5, TA793A1162 (1977).

"Standard Specification for Electrodeposited Coatings of Cadmium on Steel" *ASTM Designation A 165–71*, pp. 53–56 (1973).

*Primary Examiner*—L. Dewayne Rutledge
*Assistant Examiner*—Michael L. Lewis
*Attorney, Agent, or Firm*—Henry W. Cummings

[57] ABSTRACT

In accordance with the present invention, a coating of cadmium applied to a container pedestal latch protuberance lowers the maximum exit force sufficiently as to be within the 2200 pound maximum in the AAR specification while the minimum exit force of 1600 pounds and the maximum container entry force of 800 pounds were also within the specification.

4 Claims, 9 Drawing Figures

PLATED CONTAINER PEDESTAL LOCKING MEMBER

BACKGROUND OF THE INVENTION

U.S. Pat. No. 3,827,375 discloses railway flat cars having container pedestals including locking members which hold piggyback containers in place on railway flat cars. The locking members automatically pivot about a horizontal axis, overcoming the bias of a stiff spring, as containers are loaded and unloaded from the pedestals. A recent Association of American Railroads (AAR) specification covering latches of this type in part requires that if the hold-down device is of the self-entry or self-release type, the design should be such as to permit release of the container corner fitting when the container is pulled up through the device with a force of not less than sixteen hundred (1600) pounds nor more than twenty-two hundred (2200) pounds per corner. Self-entry or self-releasing type hold-down devices should permit engagement of the container corner fittings with entry force of not more than eight hundred (800) pounds per corner.

In testing the latches constructed in accordance with the foregoing patent with regard to compliance with the foregoing specification, it was found that the latches did not consistently meet the twenty-two hundred (2200) pound maximum exit force required to remove a container from the latch. In many cases a force considerably in excess of the twenty-two hundred (2200) pound maximum per corner was required to remove the containers from the latch. However, generally the latches did meet the minimum of sixteen hundred (1600) pounds exit force and the eight hundred (800) pound maximum per corner entry force.

One solution we attempted was to apply grease or a lubricant to the latch protuberance which would lower the coefficient of friction and thus the force required to remove a container from the latch. However, this solution would require periodic application to each of the latches on a railway flat car, usually sixteen (16) in number, and thus would be a maintenance expense and problem to be certain the lubricant was applied. Furthermore, the lubricant lowered the minimum exit force to below sixteen hundred (1600) pounds and thus out of specification.

Another solution we attempted was to apply a zinc coating to the latch protuberance to reduce the coefficient of friction and thus the maximum force. The zinc does not form a satisfactory coating to withstand the entry and exit contact with the container.

SUMMARY OF THE INVENTION

The object of the invention is to modify the container pedestal latch design disclosed in U.S. Pat. No. 3,827,375 with a suitable coating such that the container pedestal latches comply with the foregoing AAR specification.

In accordance with the present invention, a coating of cadmium applied to the container pedestal latches lowers the maximum exit force sufficiently as to be within the twenty-two hundred (2200) pound per corner maximum, while the minimum exit force of sixteen hundred (1600) pounds and the maximum container entry force of eight hundred (800) pounds were also within specification.

THE DRAWINGS

DESCRIPTION OF PREFERRED EMBODIMENTS

Figure 1:
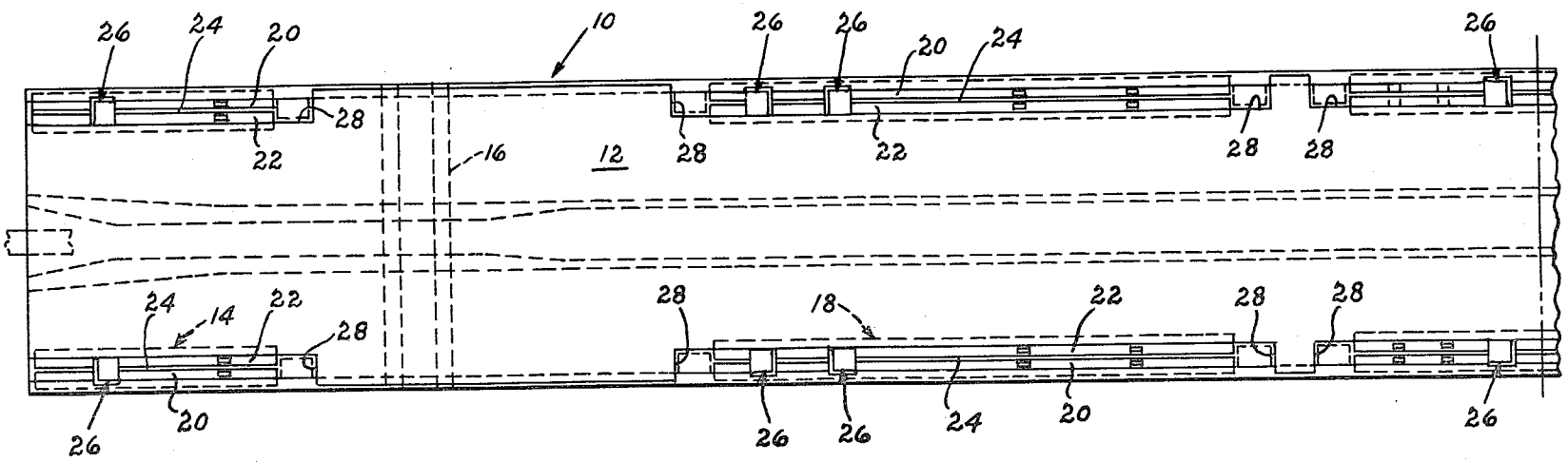
FIG. 1. PRIOR ART
FIG. 1 is a plan of a railway flat car having container corner supports mounted thereon for carrying containers.

Corresponding reference characters indicate corresponding parts through the several views of the drawings.

Figure 4:
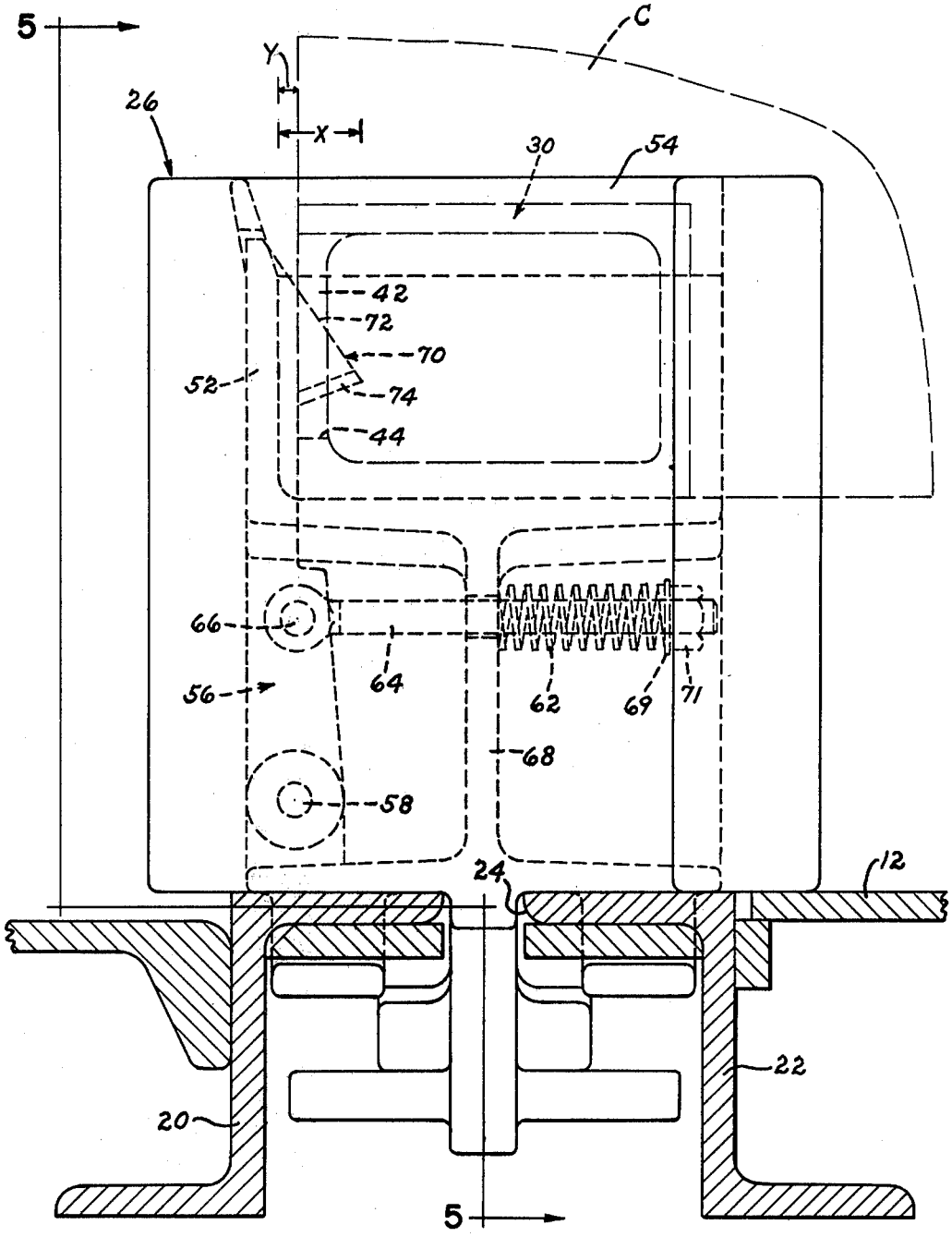
FIG. 4. PRIOR ART
FIG. 4 is an enlarged end elevation of the container support in erect position on the deck of a railway flat car.

As described in U.S. Pat. No. 3,827,375, hereby incorporated into the present application by this reference, as shown in FIG. 1, a railway flat car is generally indicated at 10 and has a generally flat deck 12. An end guideway section generally indicated at 14 is positioned between a bolster structure 16 and the adjacent end of the railway car. An intermediate guideway section generally indicated at 18 is positioned between the bolster structures 16. Guideway sections 14, 18 are formed by spaced Z-members 20, 22 having a slot 24 therebetween as shown in FIG. 4. Mounted in slots 24 for sliding movement therealong are container supports generally indicated at 26. Supports 26 may be releasably positioned at various positions along the length of guideway sections 14, 18 to adapt flat car 10 for carrying a plurality of containers of various lengths such as ten (10) feet, twenty (20) feet, twenty-four (24) feet, thirty (30) feet, and forty (40) feet. It is to be understood that only one-half the length of flat car 10 is illustrated in FIG. 1, the remaining length of the flat car being similar to that shown in FIG. 1.

Figure 2:
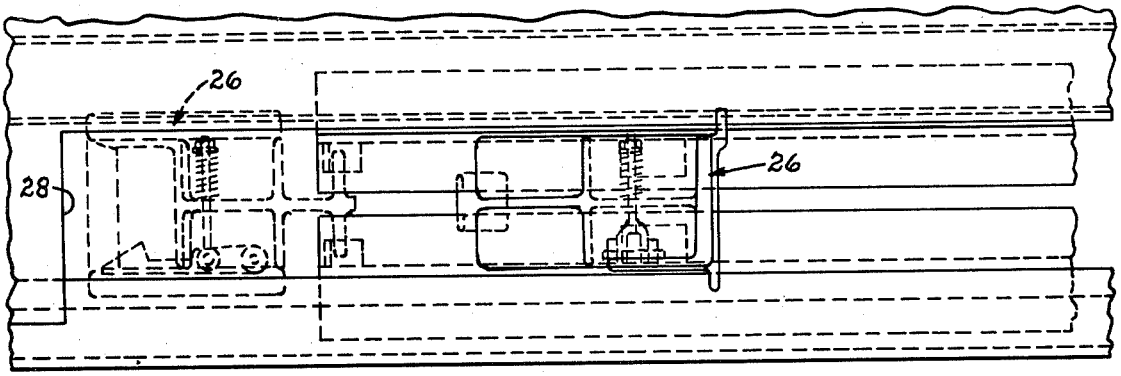
FIG. 2. PRIOR ART
FIG. 2 is an enlarged plan of a container support in erect position on the deck of the railway flat car and illustrating in broken lines the retracted position of the container support.
Figure 3:
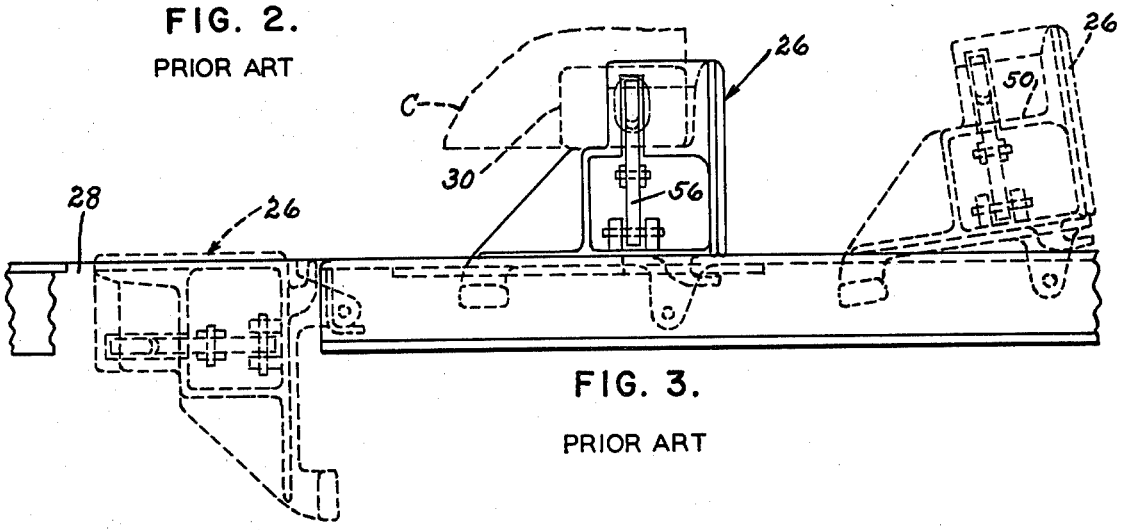
FIG. 3. PRIOR ART
FIG. 3 is a side elevation of the container corner support shown in FIG. 2 with retracted and travel positions of the support being indicated in broken lines.
Figure 5:
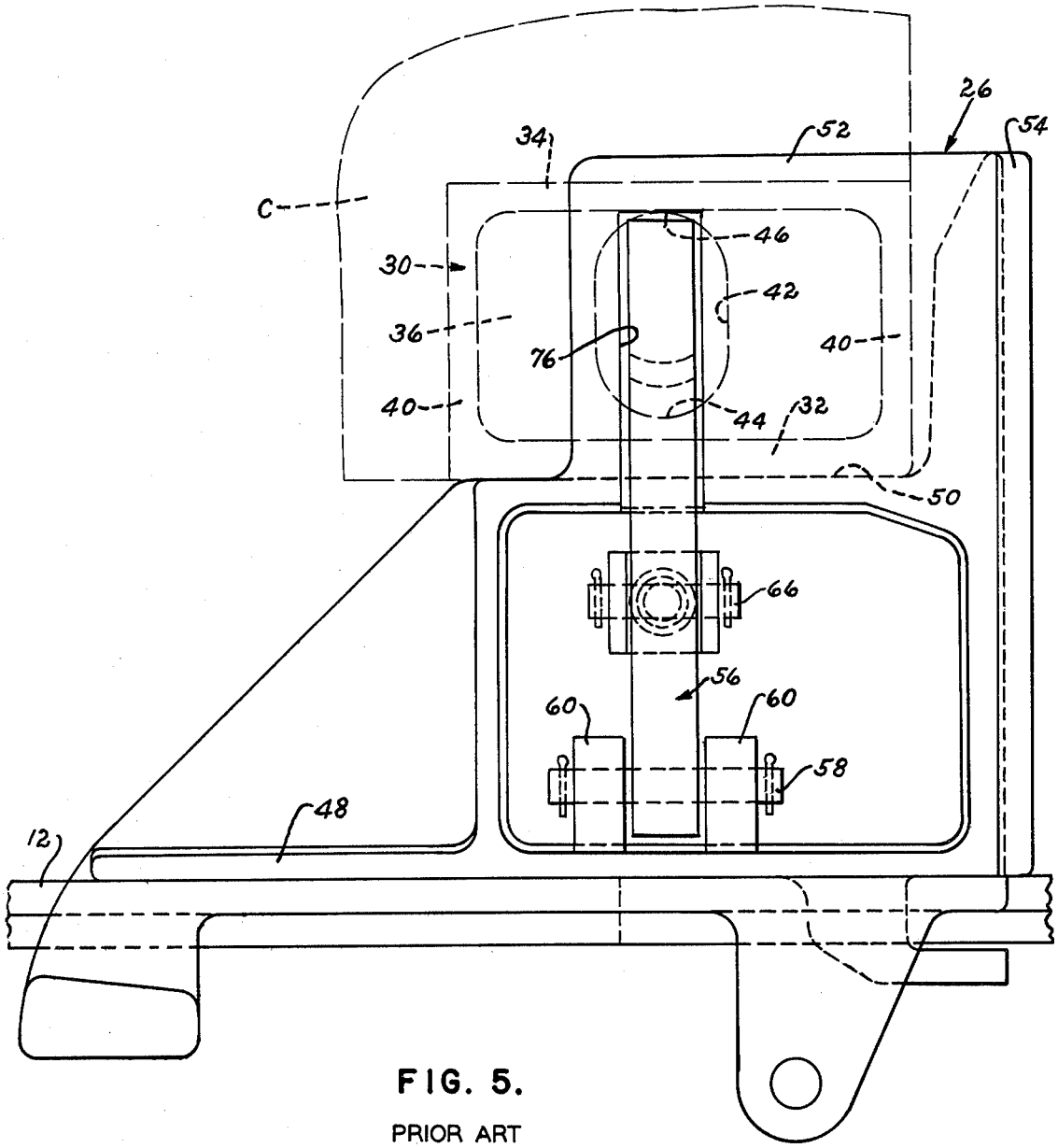
FIG. 5. PRIOR ART
FIG. 5 is a view taken generally along line 5—5 of FIG. 4 and illustrating the locking means for engaging an opening in the lower corner of a container partially shown in broken lines seated on the support.
Figure 7:
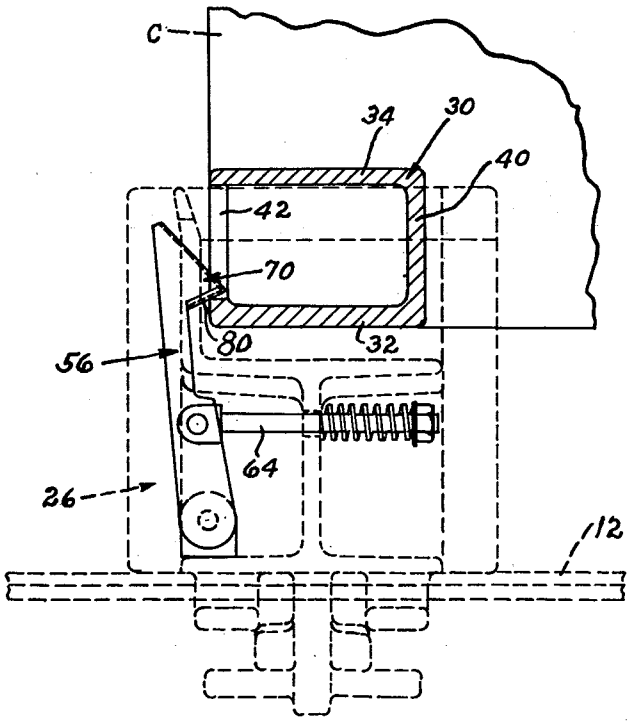
FIG. 7 is a view similar to FIG. 6 but showing the container being lifted from the flat car with a lifting force exceeding the predetermined minimum thereby to cam the locking means outwardly for releasing the container.

As shown particularly in FIGS. 2 and 3, deck 12 has cutout portions 28 adjacent the ends of guideway sections 14, 18 and supports 26 are adapted to be folded to retracted positions within cutout portions 28 to form closures for the cutout portions whereby highway tractors may be driven over deck 12 when flat car 10 is employed for the transport of trailers. Each container C has a lower corner fitting or cap 30 at each lower corner thereof. Each corner fitting 30 is generally rectangular in transverse and longitudinal cross sections and comprises a bottom wall 32, an upper wall 34, outer and inner side walls 36, 38 and end walls 40. Outer side wall 36 has an elongate opening 42 therein as shown particularly in FIG. 5. An arcuate edge 44 defines the lower portion of elongate opening 42 and an arcuate edge 46 defines the upper portion of opening 42. Arcuate edges 44 and 46 are struck from a one (1) inch radius.

Container support 26 comprises a lower base 48 adapted to rest on the upper surface of deck 12. An upper base or seat 50 supports the lower corner of a container C and a pair of connected vertical walls 52, 54 extend upwardly from seat 50. Side wall 52 and end wall 54 are arranged in a right angular relation to each other and restrain the container against horizontal movement. For further details of container support 26, reference is made to U.S. Pat. No. 3,391,654 dated July 9, 1968, the entire disclosure of which is incorporated by this reference.

The locking means is actuated without any manual actuation being required and comprises a lock lever 56 mounted adjacent its lower end on pin 58 which forms a fixed horizontal axis. Pin 58 is carried by extensions 60 secured to base 48 and forms a fixed horizontal axis for lever 56. Lever 56 may pivot back and forth on pin 58 in a vertical plane.

Continuously urging lock lever 56 inwardly is a spring 62 mounted about a rod 64 pivotally connected at 66 to lever 56. Spring 62 is biased between an intermediate wall 68 of support 26 and a retainer washer 69 on the extending end of rod 64. Nut 71 is threaded on the extending end of rod 64 to secure washer 69. Mounted adjacent the upper end of lever 56 is an inwardly extending protuberance generally indicated 70 and having an upper cam surface 72 and a lower cam surface 74. Protuberance 70 and the upper portion of lever 56 are adapted to extend within an elongate slot 76 in side wall 52 as shown particularly in FIG. 5. Protuberance 70 also is received within opening 42 of the lower corner of container C as shown is FIG. 4 when the container is seated on seat 50 and extends a distance X of around one (1) inch from the inner face of side wall 52 as illustrated in FIG. 4. Container C, if properly centered on support 26, is spaced a distance Y of one-fourth ($\frac{1}{4}$) inch from the inner face of side wall 52 as shown in FIG. 4. Distance Y may be as high as one-half ($\frac{1}{2}$) inch from the inner face of side wall 52 when container C is not centered.

In accordance with the 3,827,375 patent, lower cam surface 74 is spaced a distance of around one-half ($\frac{1}{2}$) inch from the lower arcuate edge 44 defining opening 42 when container C is fully seated as shown in FIG. 4. Cam surface 74 is proportioned to be urged outwardly by contact with arcuate edge 44 at an optimum upward lifting force of around fifteen hundred (1500) pounds or between one thousand (1000) and two thousand (2000) pounds. It should be noted that an upward lifting force of fifteen hundred (1500) pounds would be required for each support 26 which would require a total lifting force for the container of six thousand (6000) pounds. The new AAR specification requires a minimum of sixteen hundred (1600) pounds per corner to hold the container in place. This is somewhat in excess of the one thousand (1000) pound minimum contemplated by the 3,827,375 patent design.

Figure 8:
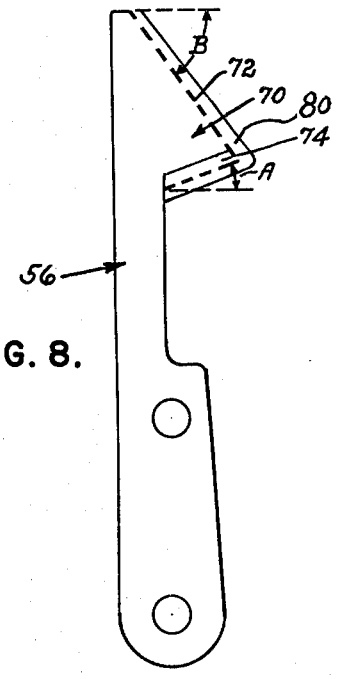
FIG. 8 is a side elevation of the locking means removed from the support and illustrating the upper and lower cam surfaces for engaging the container; and, FIG. 9 is a front elevation of the locking means shown in FIG. 8.
Figure 9:
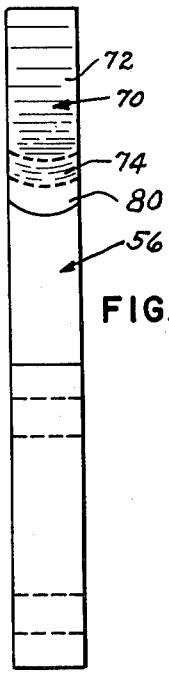

As shown in FIGS. 8 and 9, an upwardly inclined angle A of around twenty-five (25) degrees with respect to the horizontal has been found to be optimum for cam surface 74. An angle A of between fifteen (15) degrees and thirty-five (35) degrees would function effectively. As cam surface 74 engages the arcuate edge 44 defining opening 42, cam surface 74 is struck from a one inch radius corresponding to the radius from which arcuate edge 44 is struck. Therefore, a relatively large surface contact is provided between cam surface 74 and arcuate edge 44 upon lifting of container C from railway car 10. While angle A increases as lever 56 is urged outwardly, the tension in spring 62 also increases to increase the resistance to the outward movement of lever 56 thereby to compensate for the increase in angle A.

However, in actual practice it has been found that it often takes considerably in excess of two thousand (2000) pounds per corner to remove the container from the pedestal. It is believed that one of the reasons why the above described AAR specification concerning exit and entry forces was recently passed was because, in many cases, pedestal latches required considerably in excess of two thousand (2000) pounds per corner to exit from the pedestals.

Figure 6:
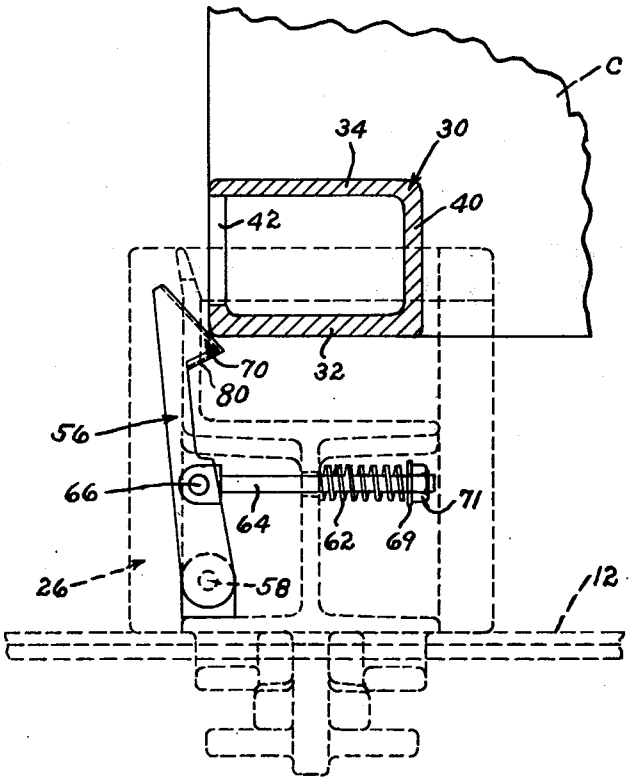
FIG. 6 is a view similar to FIG. 4 but showing the container being lowered onto the support and camming the locking means outwardly.

Upper cam surface 72 is engaged by the lower container wall 32 upon loading of the container as illustrated in FIG. 6. Cam surface 72 is proportioned so that lever 56 will be forced outwardly by wall 32 by a force or weight of around five hundred (500) pounds. As four supports 26 are required for each container, a total weight of around two thousand (2000) pounds would be required for seating of container C. An empty container of twenty feet long, eight feet wide and eight feet high weighs around six thousand (6000) pounds. An angle B for cam surface 72 of around fifty-five (55) degrees with respect to the horizontal has been found to be optimum. An angle B between around forty (40) degrees and seventy (70) degrees would function satisfactorily. The new AAR specification requires a maximum of eight hundred (800) pounds per corner for loading. In general the latches constructed according to the 3,827,375 patent met this requirement without a coating.

One proposed solution was to apply grease or a lubricant to the latch protuberance which would lower the coefficient of friction and thus the force required to remove a container from the latch. However, this solution would require periodic application to each of the latches on a railway flat car, usually sixteen (16) in number, and thus would be a maintenance expense and problem to be certain the lubricant was applied. Furthermore, the lubricant lowered the minimum exit force to below sixteen hundred (1600) pounds and thus out of specification.

Another proposed solution was to apply a zinc coating to the latch protuberance to reduce the coefficient of friction and thus the maximum force. The zinc does not form a satisfactory coating to withstand the entry and exit contact with the container.

In accordance with the present invention, a coating of cadmium applied to the container pedestal latch nose or protuberance lowered the maximum exit force sufficiently as to be within the two thousand (2000) pound maximum, while the minimum exit force of sixteen hundred (1600) pounds and the maximum container entry force of eight hundred (800) pounds were also within specification.

As shown in FIG. 8 the cadmium coating 80 only need be applied to the latch nose or protuberance 70. However, if desired, the entire latch may be coated. This may be more convenient and less expensive. In addition, the cadmium coating provides corrosion protection.

It is preferred that the cadmium coating comply with American Society of Testing Materials (ASTM) Specification No. A165-71-NS (copy in application file). The designation NS signifies that the nose or protuberance base metal is steel, and that the cadmium coating is at least about 0.00050 inches thick (13 μm). Conventional solution plating techniques may be used to apply the cadmium coating which techniques are not a part of the present invention. It is preferred however that the plated latch nose or protuberance be baked after plating at 375° F.±25° F. for about four (4) hours to avoid hydrogen enbrittlement.

In testing of cadmium coated latch noses in use on container pedestals, the following results were noted. The maximum force per corner required for containers to be removed from the container pedestals was found to be not more than about twenty-two hundred (2200) pounds. This result was consistently achieved in contrast to the somewhat erratic results obtained as to exit force without a coating. At the same time the minimum force required to lift a container from the pedestals was found to be above sixteen hundred (1600) pounds per corner. The maximum force required for a container to enter the pedestal supports was found to not exceed about eight hundred (800) pounds per corner. Thus the above described AAR regulations concerning pedestal entry and exit forces has been complied with in accordance with the cadmium coating of the present invention.

In operation, for loading, a container C is lowered onto supports 26 and the lower surfaces of walls 32 on the container corners contact upper cam surfaces 72 to urge lock levers 56 outwardly. When openings 42 are aligned with protuberances 70, levers 56 snap inwardly under the bias of springs 62 as shown in the fully seated position of the container shown in FIG. 4.

Upon unloading, container C is lifted from supports 26 and upon an upward movement of around one-half (½) inch arcuate edges 44 engage cam surfaces 74 and container C is restrained against upward movement until a predetermined force of around sixteen hundred (1600) to twenty-two hundred (2200) pounds is reached for each support 26. When the lifting force exceeds the predetermined force, levers 56 are urged outwardly to withdraw protuberances 70 from openings 42 to permit container C to be removed.

It is believed that similar results would be obtained in other container pedestal arrangements, for example, the container pedestal arrangements disclosed in U.S. Pat. Nos. 3,565,013 and 3,667,401, particularly in regard to lowering the force required for containers to exit from the pedestals, and in increasing the consistency that this lower exit force is achieved.

What is claimed is:

1. A container support for use on the deck of a railway flat car including a generally horizontal seat to support an associated lower corner of a container and a pair of connected walls arranged in a right angular relation and extending upwardly from the seat to restrain the container against horizontal movement, a releasable locking member mounted on said container support, means urging the locking member inwardly toward the container opening, said locking member including a protuberance extending inwardly from one of the walls and adapted to extend into the adjacent container opening for restraining the container against removal from the associated support at a lifting force below a predetermined minimum lifting force range; said protuberance having an upwardly inclined lower cam surface for contacting an edge of the container corner defining the lower portion of the associated container opening, upward movement of the container being restrained by said locking member until said predetermined force range is reached whereupon said locking member is urged outwardly by contact of said lower cam surface with the edge of the container corner defining the opening, the improvement comprising: said protuberance having a coating of cadmium thereon whereby to reduce said predetermined force range required to remove the container from said pedestal to within sixteen hundred (1600) to twenty-two hundred (2200) pounds.

2. A container support according to claim 1 wherein the force required for a container to enter said pedestal does not exceed about eight hundred (800) pounds.

3. A container support for use on the deck of a railway flat car including a generally horizontal seat to support the lower corner of a container and a pair of connected walls arranged in a right angular relation to form side and end walls extending upwardly from the seat to restrain the container against horizontal movement, said support further comprising an intermediate wall extending longitudinally of the car below said horizontal seat; said side wall having a slot located above said horizontal seat; a releasable locking lever on each container support; means mounting the locking lever upon said side wall below said slot for generally pivotal movement adjacent the side wall about a generally horizontal axis extending longitudinally of the car; the upper portion of said locking lever having a protuberance extending within the slot and adapted to extend within an elongate container opening for restraining the container against upward movement at a lifting force below a predetermined minimum lifting force range; resilient means urging the upper portion of the locking lever and protuberance inwardly into the container opening; said protuberance having a lower cam surface for contacting said arcuate concave edge defining the lower portion of the elongate container opening, said lower cam surface being inclined upwardly with respect to the horizontal and being generally arcuate and convex in cross section to fit against the adjacent concave edge of the wall defining the lower portion of the elongate container opening in a generally nested relation; said protuberance being inclined with respect to the horizontal and being generally arcuate and convex in cross section to fit against the adjacent concave edge of the wall defining the lower portion of the elongate container opening when the container is lifted from the support; said protuberance further having a downwardly inclined upper cam surface adapted to contact the container upon lowering of a container onto the container support for urging the protuberance outwardly against the bias of said resilient means, the protuberance being urged within the container opening by the resilient means upon seating of the container on the support; and an upward movement of the container being restrained by the lower cam surface on said protuberance until a predetermined minimum force range is obtained, whereupon said protuberance is urged outwardly to release the container; the improvement wherein said protuberance has a coating of cadmium thereon whereby to reduce said predetermined force range required to remove the container from said pedestal to within sixteen hundred (1600) to twenty-two hundred (2200) pounds.

4. A container support according to claim 3 wherein said resilient means comprises a rod pivotally connected at one end to said resilient means below said seat, said rod passing through an opening in said intermediate wall, and including a compression spring mounted thereon and held in place by said intermediate wall and fastening means at the opposite ends thereof.

* * * * *